US005435164A

United States Patent [19]

Di Giusto et al.

[11] Patent Number: 5,435,164

[45] Date of Patent: Jul. 25, 1995

[54] APPARATUS AND METHOD FOR THE MANUFACTURE OF HOT ROLLED METAL STRIP

[75] Inventors: Bruno Di Giusto, Udine, Italy; Vladimir B. Ginzburg, Pittsburgh, Pa.

[73] Assignees: International Rolling Mill Consultants, Inc.; Danieli United, Inc., both of Pittsburgh, Pa.; Danieli & C. Officine Meccaniche SpA, Buttrio, Italy

[21] Appl. No.: 101,603

[22] Filed: Aug. 3, 1993

[30] Foreign Application Priority Data

Aug. 26, 1992 [IT] Italy ..... UD92A0135

[51] Int. Cl.[6] ..... B21B 1/32

[52] U.S. Cl. ..... 72/202; 72/229; 72/234; 72/366.2

[58] Field of Search ..... 72/200, 202, 229, 234, 72/365.2, 366.2; 29/527.7

[56] References Cited

U.S. PATENT DOCUMENTS

| | | | |
|---|---|---|---|
| 4,308,739 | 1/1982 | Tippins | 72/229 |
| 4,348,882 | 9/1982 | Tippins | 72/202 |
| 4,430,874 | 2/1984 | Tippins et al. | 72/202 |
| 4,503,697 | 3/1985 | Tippins et al. | 72/202 |
| 4,522,050 | 6/1985 | Thomas | 72/229 |
| 4,587,823 | 5/1986 | Eibe | 72/229 |
| 4,675,974 | 6/1987 | Connolly | 72/229 |
| 4,793,169 | 12/1988 | Ginzburg | 72/229 |
| 4,998,338 | 3/1991 | Seidel et al. | 29/527.6 |
| 5,140,837 | 8/1992 | Thomas et al. | 72/229 |
| 5,150,597 | 9/1992 | Sekiya et al. | 72/229 |

*Primary Examiner*—Lowell A. Larson
*Assistant Examiner*—Thomas C. Schoeffler
*Attorney, Agent, or Firm*—Panitch Schwarze Jacobs & Nadel

[57] ABSTRACT

The present invention relates to a compact rolling plant and method for using it to manufacture hot rolled metal strip. The rolling mill and method are capable of rolling both thick and thin slabs with minimum delays between slabs. The complete rolling of a bar or a strip below a critical transformation temperature range may be done at any speed without heat losses in unrolled portions of the strip or bar.

16 Claims, 5 Drawing Sheets

Rolling Load Tonnes
3500
3000
2500
2000
1500
1000
500
0
Pass n. 1 2 3 4 5 6 7 8 9 10 11 12 13 14 15
Stand n. 10a 10b 10c 10d 10e 10e 10d 10c 10b 10a 10a 10b 10c 10d 10e Temp. (°C)
1250
1200
1150
1100
1050
1000
950
900
850
800
A B C D 10a 10b 10c 10d 10e 10e 10d 10c 10b 10a 10a 10b 10c 10d 10e
□ Leading end + Centre x Trailing end

APPARATUS AND METHOD FOR THE MANUFACTURE OF HOT ROLLED METAL STRIP

FIELD OF THE INVENTION

The present invention relates to an apparatus and method for the manufacture of hot rolled metal strip and, more particularly, to a method to produce thin sheet and also a compact rolling plant which employs such method.

The present invention also relates to a rolling mill and method capable of rolling both thick and thin slabs with minimum delays between slabs. Further, the present invention also relates to a rolling mill and method of using it for complete rolling of a bar or a strip below a critical transformation temperature range at any speed without heat losses in unrolled portions of the strip or bar.

This invention is applied advantageously downstream of a continuous caster and serves for the production of thin sheet having thicknesses down to one millimeter and less.

The method and compact rolling plant according to the invention enable a plant of at least the same quality to be built with a considerable reduction of the overall size as compared to known plants of the same type. Such size reduction may be as much as thirty percent or more.

BACKGROUND O THE INVENTION

Rolling plants to produce thin sheet are well known and widely used in the state of the art.

Normally, in such plants to produce strip having thicknesses of the order of about one millimeter (mm.), a casting leaving a normal continuous casting plant with a thickness of about 200 to 250 mm. is sheared into slabs having a length of about 12 to 15 meters (m.).

These slabs generally undergo a post-heating step within a temperature equalization furnace and are then subjected to a process of reduction of width, for instance, by means of vertical rolling rolls.

Thereafter, after having been advantageously subjected to one or more processes to remove scale which forms during the thermal treatments, the slabs come into cooperation with at least one reversible rolling stand.

The rolling cycle normally used, as detailed in U.S. Pat. Nos. 4,430,874 and 4,503,697 for instance, subjects these slabs to a plurality of successive passes alternately in one direction and the reverse direction within one or two reversible rolling stands to form a transfer bar or a strip having a thickness of about 25 to 30 mm.

The bar or strip thus obtained is sent lastly to a continuous, semi-continuous, or reversing finishing mill which reduces the thickness of the strip to the required value.

The finished strip downstream of this finishing mill is wound in coils on a winding machine.

The plants of the state of the art entail a series of drawbacks. First of all, the number of rolling passes is generally small, and this leads to a great reduction of thickness in each pass and therefore to an increase in energy consumption per unit of rolled steel.

Moreover, in such plants the finishing stands positioned downstream are not used during the rolling carried out by the upstream reversible rolling stands.

It follows that at the time of their use the rolls of the downstream stands have temperatures substantially different from the temperatures of the rolls of the upstream stands, and this creates problems as regards the flatness and profile of the strip.

Lastly, to be able to carry out this method, the rolling plants commonly used require great lengths for their rolling line upstream and downstream of the reversible rolling stand. In fact, the progressive reductions of the thickness of the slab, transfer bar and strip lead to a corresponding increase in the length of the slab, transfer bar and strip requiring a plant large enough to handle the rather long strip.

Obviously, the whole length of the transfer bar has to proceed outside the reversible rolling stand before its direction of feed is reversed and the transfer bar undergoes a further pass through the reversible rolling stand.

For this reason and given the dimensional values previously mentioned for the strip, it is necessary to provide a free space of at least 50 to 70 m. between the temperature equalization furnace and the rolling stand and a free space of at least 80 to 120 m. between the rolling stand and the finishing mill.

It is clear that these dimensions entail a considerable engagement of resources in terms of the sizes of the factory and in terms of energy costs and costs for the setting-up and upkeep of the plants.

The article by Vladimir B. Ginzburg and Winfried F. Schmiedberg in the trade journal *Iron and Steel Engineer* of April 1986 discloses a method in which a plurality of rolling stands is used in one direction and the opposite direction until the final thickness of the strip is achieved, but there is no disclosure of how to obviate too great wear of the rolls of the downstream stands and to reduce losses of heat.

The rolling plants of the state of the art are also problematic in that they may receive slabs from two or more continuous casters where the slabs produced have generally equal thicknesses. By continuously casting slabs of generally equal thickness, the rolling plant is limited to producing only those grades of steel which can be produced from that particular slab thickness. Further, rolling plants which receive single thickness slabs from a continuous caster are usually limited to rolling either plate or strip. Thus, a need has arisen for a rolling plant which includes at least two continuous casters which produce slabs of different thicknesses and a rolling mill which can roll different thickness slabs to increase the number of grades of steel the plant can produce and with a minimum delay between slab processing.

In the conventional reversing rolling plants, thermomechanical treatment during rolling is conducted by either conventional hot rolling, controlled rolling, low finishing temperature rolling or continuum rolling. In conventional hot rolling, the hot rolling of steel is conducted continuously and is usually finished above the upper cooling transformation temperature $Ar_3$. The upper cooling transformation temperature $Ar_3$ is the temperature at which the austenite (the gamma phase) in the steel begins to transform into ferrite such that there is a mixture of austenite and ferrite in the steel (the gamma-alpha two-phase mixture). The exact temperature that the transformation occurs depends upon the content of the carbon in the steel, but usually is in the range of about 720 to about 920 degrees C. The temperature range above the upper cooling transformation temperature $Ar_3$ is referred to herein as the "gamma region".

In controlled rolling, the rolling metal is interrupted by one or two delays which allows one to deform the steel first in the gamma-region and then in a temperature range between the upper cooling transformation temperature $Ar_3$ and the lower cooling transformation temperature $Ar_1$ (the gamma-alpha two-phase region). At the lower cooling transfer temperature, all of the austenite has transformed into ferrite, such that there is only ferrite in the steel. Again, the exact temperature that the transformation occurs depends upon the content of the carbon in the steel, but usually is about 720 degrees C.

In low finishing temperature rolling, the finishing rolling passes are conducted in a temperature range between room temperature and below the lower cooling transformation temperature $Ar_1$ (the alpha region), usually in the range of about 600 to about 720 degrees C. (the upper end of the alpha region). When the temperature of the steel enters the alpha region the ferrite begins to transform into pearlite.

A rolling plant is capable of continuum rolling when it is able to achieve deformation in the gamma-region, gamma-alpha region and alpha region. Conventional reversing rolling hot strip mills have not been able to produce thin gauges by rolling in the lower end of the alpha region at a temperature range of about 20 to about 400 degrees C., because the transfer bar that enters the finishing mill stands is usually too thick, ranging from 20 to 30 mm; so it would require either to substantially increase mill roll power or to increase the number of mill roll stands or both to roll thin gauges at low temperatures. The prior art solution to this problem has been to ship the product to a cold rolling plant for final processing. This obviously increases the cost of the final product and increases the manufacturing time.

Hence, a need has arisen for a reversing rolling plant which can achieve rolling in the gamma region, gamma-alpha region, and both the upper and lower ends of the alpha region. That is, there is a need for a reversing hot rolling plant which can produce intermediate thin strip of about 8 mm to about 4 mm in coil form to conserve heat and to roll this strip down to finish gauge while maintaining precise control of mechanical deformation by controlling reduction in thickness, mill speed, and cooling rate of the strip; thus allowing the plant to roll a relatively greater number of different steel products which are presently produced by cold mills. The present invention satisfies this need.

The present inventors have studied, tested, and created and developed this invention to overcome the shortcomings of the state of the art and to achieve further advantages which will be apparent after reviewing the foregoing and following specification.

SUMMARY OF THE INVENTION

One aspect of the present invention is a method for producing thin strip, starting from slabs of a desired length, whereby the slabs are heated, then undergo a reduction of width and are then descaled and rolled in a series of rolling stands having downstream a cooling roller table, upstream a first coiler and downstream a second coiler, wherein the improvement comprises producing the thin strip from both thick and thin slabs comprising the steps of first progressively rolling each thick slab in the series of rolling stands pre-set for a first series of thickness reduction for that first rolling; resetting the roll stands for a second series of thickness reduction; repassing the first progressively rolled slab through the series of rolling stands in the reverse direction to produce a coilable bar; coiling and heating the bar within a coiler furnace; resetting the roll stands again for a third series of thickness reduction; uncoiling and re-rolling the bar through the series of rolling stands to produce the final strip; and progressively rolling each thin slab in the series of the rolling stands pre-set for a single pass thickness reduction by each stand to produce the final strip; the thickness reduction applied be the stands being greater in a first predetermined number of stands compared to a smaller thickness reduction of a second predetermined number of stands in the series of the rolling stands.

The present invention also provides for maintaining the temperature of the coilable bar above a critical alpha region temperature at which metal in the bar begins to transform from ferrite to pearlite. The bar after uncoiling is preferably cooled and simultaneously re-rolled and passed through the roll stands such that the bar is at a temperature in the alpha region.

A related aspect of the present invention is a compact rolling plant to produce thin metal strip, which comprises downstream of a continuous caster at least one heating and temperature equalization furnace, a unit to reduce the width of slabs, a descaling unit, a coiling-unwinding unit with heating means, and a series of rolling stands including from three to seven rolling stands, each rolling stand possesses at least three steps of adjustment, each step in one rolling stand being adjusted with the corresponding rolling step of the next stand, the steps of thickness reduction of a first predetermined number of the rolling stands next to the coiling-unwinding unit being between about 24% and about 60% in each of these stands, and the steps of thickness reduction of the remaining rolling stands being between about 4% and about 15% in each of these stands, during the first two passes through the series of rolling stands.

A purpose of this invention is to obtain a method for the production of thin sheet and also a compact rolling plant which employs such method, the method and plant achieving a considerable reduction in the space required as compared to the rolling plants of the state of the art.

A further purpose of the invention is to provide a method and plant whereby it is possible to reduce the energy consumption per unit of rolled steel, the wear of the rolls of the downstream stands is controlled, the surface heat value of the rolls on all the rolling stands is uniform and the losses of heat of the strip are reduced during the rolling steps.

The invention therefore enables great savings to be achieved in terms of energy, maintenance and plant costs and at the same time makes possible the production of a thinner finished thickness.

BRIEF DESCRIPTION OF THE DRAWINGS

The foregoing summary, as well as the following detailed description of preferred embodiments of the invention, will be better understood when read in conjunction with the appended drawings, where like numerals indicate like elements throughout the several views. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENTS

The reference number 10 in the figures indicates a compact rolling plant according to the invention for the production of thin sheet.

A casting 20 which may be a thick casting or a thin casting, depending on the adjustments made in a known manner to a continuous coating plant or continuous caster 11, is shown leaving the continuous caster 11. The thick casting has a thickness of about 75 mm. to about 250 mm., preferably about 100 mm. to about 200 mm. and more preferably in the range of about 130 mm. to about 160 mm. The thin casting has a thickness of about 25 mm. to about 75 mm., and typically of about 40 mm. to about 60 mm.

Figure 1:
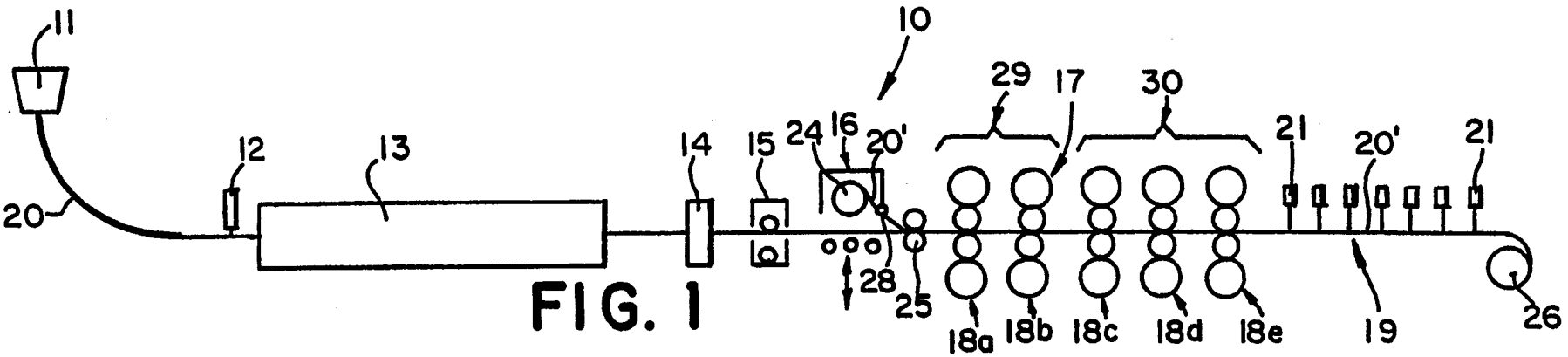
FIG. 1 is a schematic diagram of a first rolling plant according to a first preferred embodiment of the invention.

Although a continuous caster 11 is shown as part of the overall plant in FIG. 1, more than one continuous caster could be used, with appropriate roll tables, furnaces and other accessories, to produce thick and thin castings. So that a plant could be built in stages and construction and installation costs controlled, the castings could be obtained from vendors or from inventory, and heated to the appropriate temperatures by reheating furnaces or the like.

The casting undergoes a step of being sheared into workpieces in the form of slabs having the respective thickness of the castings, and of a pre-set length, in the case of a thick slab, for example, about 10 m. to about 20 m. preferably in the range of about 10 m. to about 15 m., by a shears 12. The slabs are fed, one at a time, into a temperature equalization furnace 13 and thereafter are made to cooperate with a device 14 that reduces their width and trims their lateral edges.

At least one descaling device 15 in this example is included downstream of the width reduction device 14.

Thereafter, the slabs are passed through a series 17 of four-high rolling stands, which in this case consists of five stands 18, namely 18*a*, 18*b*, 18*c*, 18*d* and 18*e*, respectively.

In this case the five rolling stands are regulated in such a way as to obtain a greater reduction of thickness in a first predetermined number of stands, such as the first two stands 18*a* and 18*b*, which can be called "upstream" stands 29, and a smaller thickness reduction in a second predetermined number of stands, such as the other three stands 18*c*, 18*d* and 18*e*, which can be called "downstream" stands 30.

The definition of "upstream" stands 29 and "downstream" stands 30 should be understood in this case as being only a convenient way for distinguishing between the stands 18 since, when a thick slab 20 passes through the series 17 of four-high rolling stands in the reverse direction, the "downstream" stands 30 are passed through by the slab 20 before the "upstream" stands 29.

The first pass of a thick slab through the series 17 of four-high rolling stands leads to a progressive reduction of the thickness of the slab 20 passing through, until at position 19 a transfer bar 20' about 60 mm. to about 70 mm. thick and about 30 m. to about 40 m. long is obtained. In-line cooling means 21 is included advantageously in this zone.

When the workpiece originating from a thick slab, in the form of the slab 20 or transfer bar 20' has passed completely out of the series 17 of four-high rolling stands, as, for example, when travelling from left to right in FIG. 1, the direction of feed of the transfer bar 20' is reversed and the transfer bar 20' is passed in the reverse direction through the series 17 of stands, which in the meantime have been readjusted to roll in the opposite direction.

Figure 2B:
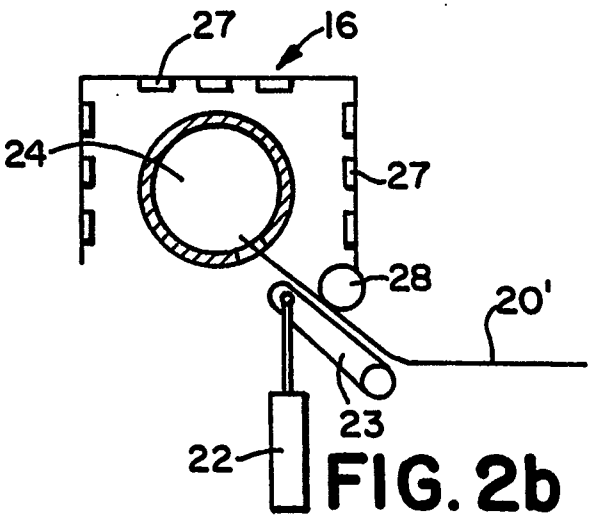
FIGS. 2*a* and 2*b* schematically show a detail of the rolling plant of FIG. 1 in two working steps.
Figure 2A:
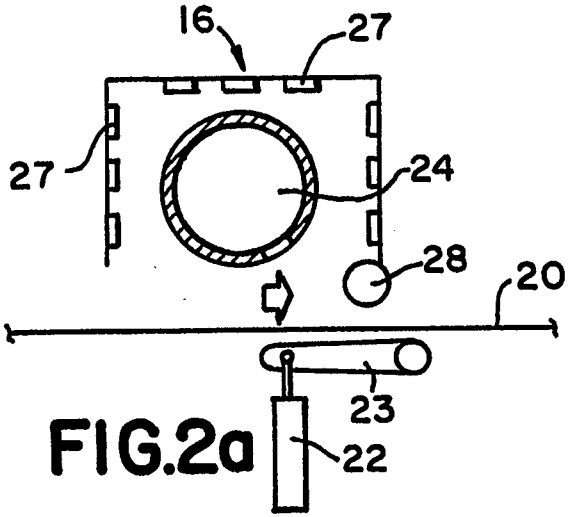

At this point a cylinder-piston actuator 22, which permitted the first pass of the slab 20 to be carried out without any obstruction (FIG. 2*a*), is now actuated to act on the gate 23. The gate 23 in cooperation with a deflector roll 28, during a reverse pass, as, for example, when the transfer bar is travelling from right to left in FIGS. 1 and 2*b*, cause the transfer bar 20' leaving the series 17 of four-high rolling stands to be deflected upward and to be wound on a coiling-unwinding unit 24 such as a coiler drum, within a coiler furnace of the coiling-unwinding station 16 (FIG. 2*b*).

Heating means 27 of any well known type maintains the temperature of the transfer bar 20' at the desired level in the coiling furnace of the coiling-unwinding station 16, in cooperation with the coiling-unwinding unit 24.

In the coiling-unwinding station 16 the reduced transfer bar 20' may be considered a strip. If the third pass is to be carried out above the lower cooling transformation temperature, the transfer bar 20' has a thickness of about 10 mm. to about 20 mm. and the length of the coiled transfer bar or strip 20° is about 100 m. to 200 m., and preferably in the range of about 120 m. to about 180 m. On the other hand, if the third pass is to be carried out below the lower cooling transformation temperature, the transfer bar 20' has a thickness of about 8 mm. to about 4 mm.

This coiling-unwinding station 16 is positioned advantageously in the immediate vicinity of the series 17 of four-high rolling stands so as to reduce to a minimum the overall length of the rolling line or passline and to avoid too much loss of heat by the transfer bar or strip 20'.

When the transfer bar or strip 20' has been fully wound on the coiling-unwinding unit 24, possibly after parts of the leading or trailing ends of the transfer bar or strip 20' have been removed by a flying shears 25, the coiling-unwinding unit 24 reverses its rotation and unwinds the wound transfer bar or strip 20' originating from the thick slab for a new or third pass through the series 17 of four-high rolling stands, which have been readjusted to produce the required final thickness. The transfer bar or strip 20' can be simultaneously cooled by adjusting the time of the pass or by separate well-known cooling means, if necessary or desired (not shown).

This further pass brings the transfer bar or strip 20' to the required thickness of the finished strip, which can be as thin as about 1 mm. If the ends of the transfer bar 20' had not been cut during its coiling on the coiling-unwinding unit 24, these ends may be cut during unwinding from this unit while the last rolling pass is being performed.

The finished strip 20', which is possibly still cooled by cooling means 21, is wound on a coiling unit 26 and, lastly, is removed from the rolling plant 10.

A final gauge strip is made from the thin slab simply by a single pass through the four-high rolling stands 17 adjusted to have the appropriate rolling force.

Preferably one of a thick and thin slab is processed, and then the other of the thick and thin slab is processed. More preferably, this alternative processing is repeated using either a single caster capable of forming castings of different thickness, and more preferably, from two separate continuous casters, one forming a thick casting and the other forming a thin casting, preferably one of a thick and thin slab is processed, and then the other of the thick and thin slab is processed.

An example of the operation of the rolling plant 10 follows.

A thick casting leaving the continuous casting plant and having a thickness of about 100 mm. to about 200 mm., and preferably in the range of about 130 mm. to about 160 mm., undergoes the usual operations of being sheared into slabs of a pre-set length, about 10 m. to about 20 m., and preferably in the range of about 10 m. to about 15 m., for instance, of being heated and having its temperature equalized, of being reduced in width and of being descaled.

Next, the thick slab carries out its first pass through the series of four-high rolling strands, which have been adjusted for a progressive rolling in steps of thickness.

This first pass causes a reduction in the thickness of the slab down to transfer bar values of about 50 mm. to about 70 mm., and preferably in the range of about 60 mm. to about 70 mm., and a corresponding length of about 30 m. to about 40 m.

Next, if the third pass is to be carried out above 10 the lower cooling transformation temperature, the progressive adjustment of the series of four-high rolling stands is reset in the reverse direction and the direction of feed of the strip is reversed, and the strip is re-rolled in the reverse direction until its thickness amounts to about 10 mm. to about 20 mm. and preferably in the range of about 10 mm. to about 15 mm., while its length reaches about 100 m. to about 200 m., and preferably about180 m. to about 200 m. If the third pass is to be carried out below the lower cooling transformation temperature, the progressive adjustment of the series of four-high rolling stands is reset in the reverse direction and the direction of feed of the strip is reversed, and the strip is re-rolled in the reverse direction until its thickness amounts to about 8 mm. to about 4 mm.

During these two passes in opposite directions the series of four-high rolling stands is set in such a way that they produce a great reduction of thickness in the first stands of the series, for instance equal to a value between about 24 percent and about 60 percent in each of the first two stands, and a much smaller reduction, between about 4 percent and about 15 percent, in the remaining stands of the series of rolling stands. This enables the wear of the rolls of the downstream stands to be reduced substantially.

The slab leaving this progressive series of four-high rolling stands is now wound in coils on the coiling-unwinding unit, with which a flying shears may cooperate to perform any shearing of the leading or trailing ends of the strip.

The slab is rolled to transfer bar thickness of about 10 mm. to about 20 mm. The transfer bar, while being wound on the coiling-unwinding unit, undergoes a heating action, which has the purpose of bringing the transfer bar to the required temperature; this heating action may also be prolonged beyond the period of the coiling, thus preventing the loss of heat during the rolling process unless cooling is desired to below the lower cooling transformation temperature, described above.

This aim of reducing the loss of heat is achieved also by selecting the thickness of the slab or transfer bar at the outlet of the first pass through the series of four-high rolling stands in such a way that the ratio between that thickness of the transfer bar and the radiation time is greater than a value of about 0.5 mm. to about 0.75 mm. per second, and preferably about 0.75 mm. per second.

By radiation time is meant the time during which the transfer bar being rolled remains out of contact with the rolling rolls and is not wound on the coiling-unwinding unit.

When the coiled transfer bar has been heated to the required value, the coiling-unwinding unit reverses the direction of rotation and unwinds the coil thus formed, thus permitting a further pass within the series of four-high rolling stands, again, with or without cooling, depending on the desired product.

This further pass brings the transfer bar to the desired reduced thickness, namely a particularly thin strip to about 1 mm. thick.

An example of the alternate single pass rolling of a thin slab to a thin strip of final desired gauge is discussed below particularly with respect to FIG. 10B.

This particularly thin thickness can be achieved, on the basis of the characteristics of the invention, owing to the increased number of passes available, the retention of the heat or controlled cooling, as desired, the uniformity of the surface temperature of the rolls and the reduction of wear of the rolls.

The finished strip coming from the last pass (or first pass of a thin slab) through the rolling stands is wound, optionally but typically after an in-line cooling step, on a winding machine and is removed from the rolling line.

It can be clearly seen that this method enables the 10 space required upstream of the series of four-high rolling stands to be reduced to a minimum.

According to the invention the series of four-high rolling stands includes from three to seven stands, but preferably five stands. Similarly, the rolling stands can be anywhere from two- to six-high rolling stands without departing from the spirit and scope of the invention.

Figure 3:
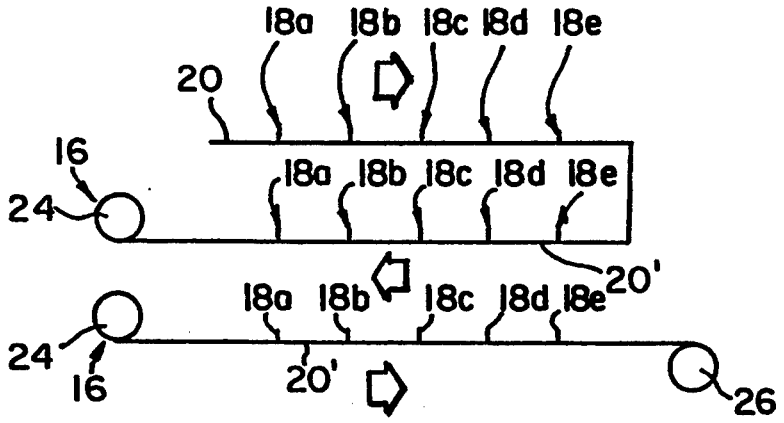
FIG. 3 shows the working cycle of the plant of FIG. 1.

FIG. 3 is a diagram of the working steps of the rolling plant 10 according to the invention and shows the successive passes of the slab 20 and transfer bar 20' originating from a thick casting or slab through the series 17 of four-high rolling stands so as to produce a finished strip 20' of the required thickness.

Figure 4:
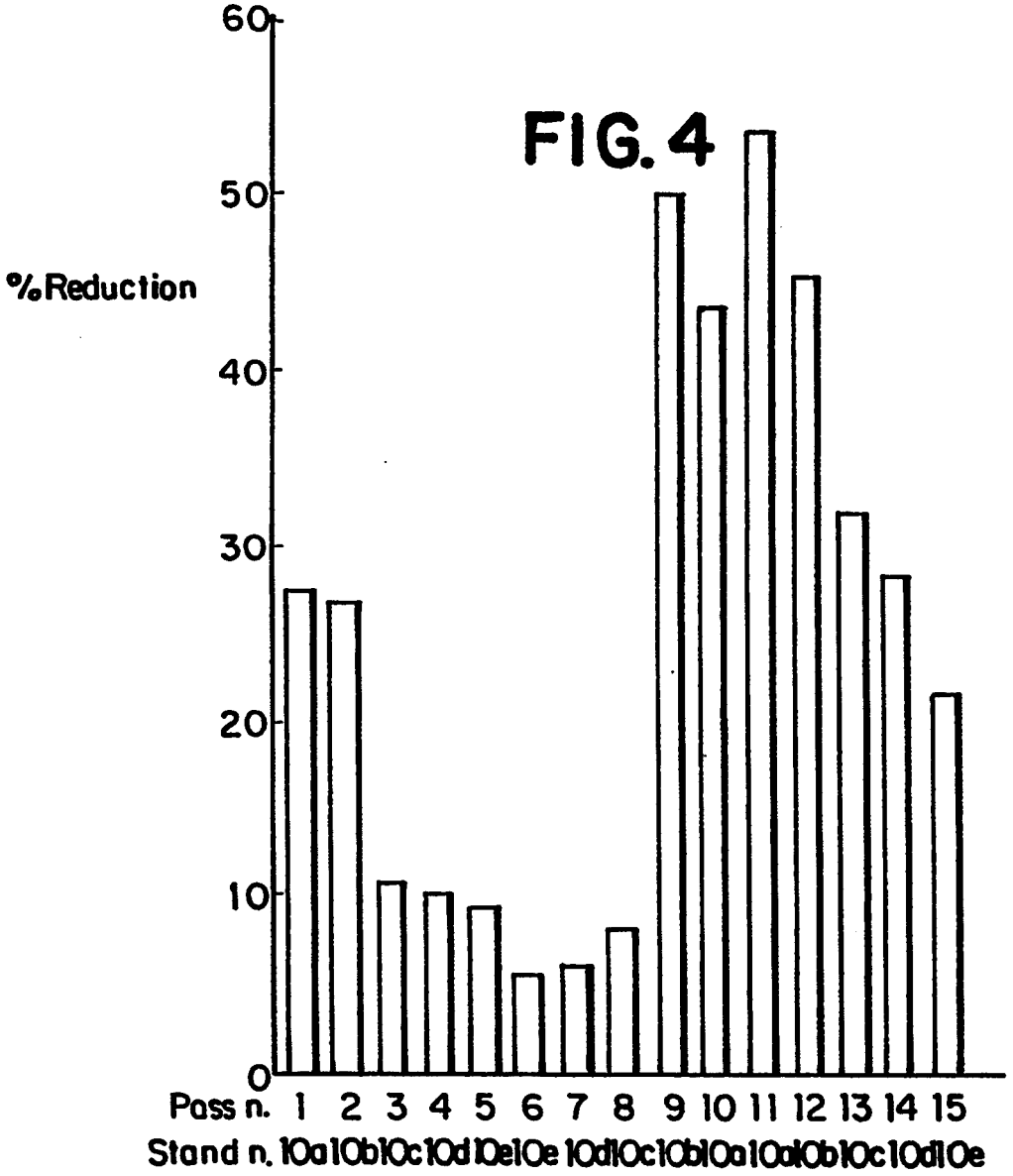
FIG. 4 gives a diagram of an example of the percentage reduction of thickness of the slab after each pass.
Figure 5:
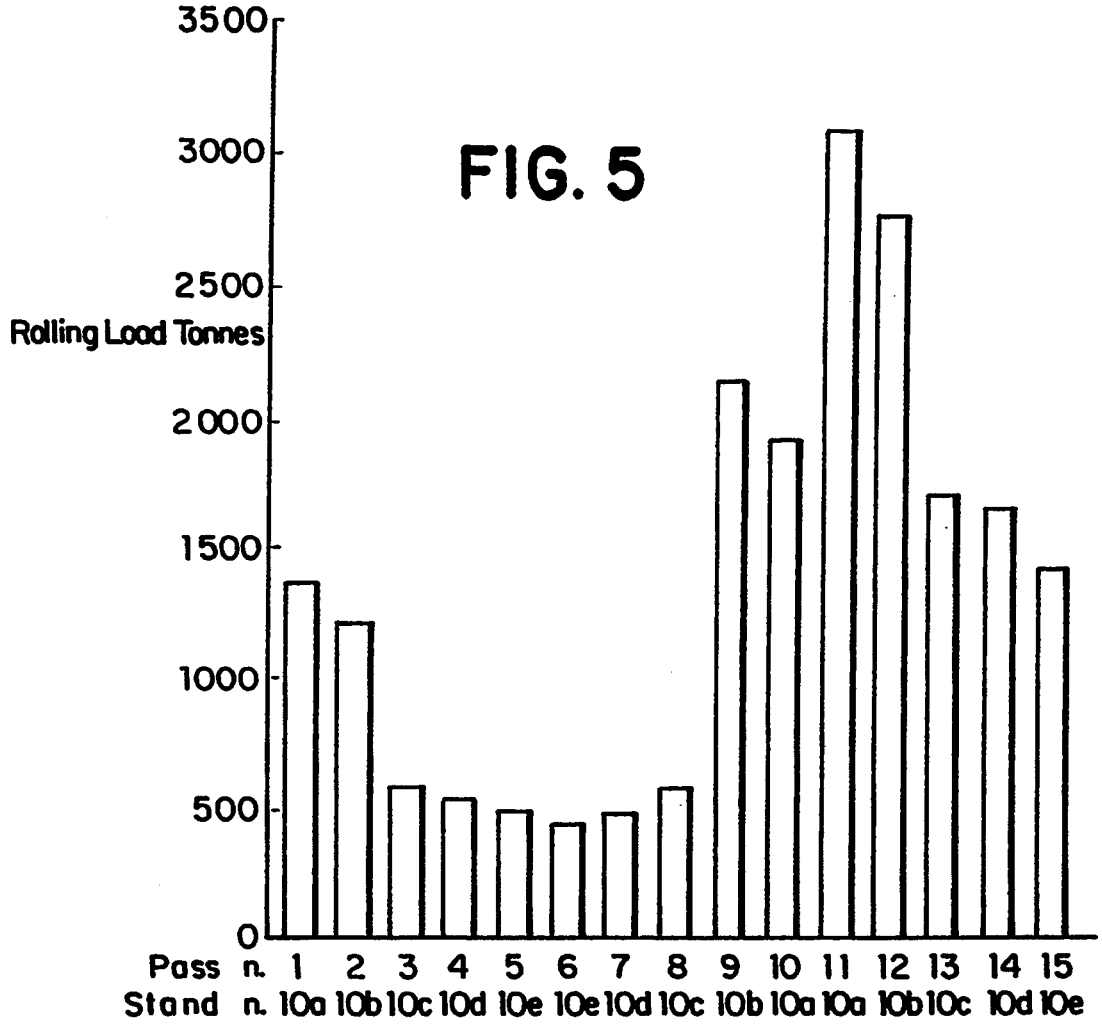
FIG. 5 gives a diagram of an example of the values of rolling pressure applied to each roll in each pass.
Figure 6:
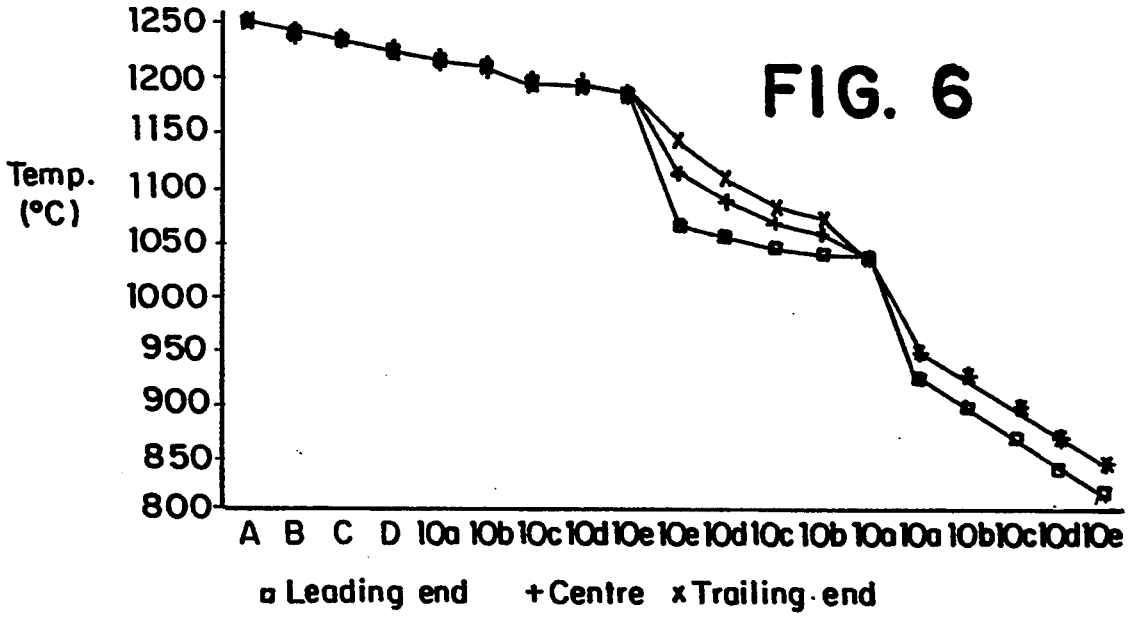
FIG. 6 is a graph of the reduction of temperature of the slab on leaving each pass.

The diagrams of FIGS. 4, 5 and 6 show graphically an example obtained by using the rolling method according to the invention on thick slabs 20 having an initial thickness of 150 mm. and a length of 12.22 m. and arriving at a finished strip 1.5 mm. thick and 1,250 mm. wide.

FIGS. 4 and 5 respectively show the percentage reductions of thickness after each pass through each rolling stand 18 and the relative values of load applied in each stand 18 in each pass.

FIG. 4 shows that the percentage reduction of thickness is much more accentuated in the first two rolling stands 18*a*–18*b*, namely the "upstream" rolling stands 29, when the strip is passed through those stands 29 in one direction (passes one and two) or the opposite direction (passes nine and ten), than in the other rolling stands 18*c*, 18*d* and 18*e*, namely the "downstream" rolling stands 30.

In this example, the relative values for each pass are about the following:

forwards: 26–27%; 25–26%; 10–11%; 10%; 9% backwards: 5–6%; 6%; 8–9%; 49%; 43–44% coiling and heating forwards: 52–53%; 44–45%; 31–32%; 27–28%; 21–22%.

FIG. 5 indicates that the rolling load is heavier in the "upstream" rolling stands 29 than in the "downstream" rolling stands 30 to achieve the desired thickness reductions.

FIG. 6 is a graph to indicate the progress of the temperature of the workpiece during the rolling. This temperature is shown respectively as the temperature of the leading end, center and trailing end of the slab 20, starting from the reheating furnace temperature at a value of about 1,250 degrees C. and proceeding to the temperature at the end of the third and last pass when leaving the last rolling stand 18*e* at a value of about 850 degrees C.

The graph of FIG. 6 also shows the values corresponding to the pass in each rolling stand and preceded by the values corresponding to the passes through the other units forming the rolling line, in which: A, B, C, and D represent the temperature rundown between the equalizing furnace 13 and the first stand 18*a* of the rolling mill.

Figure 7:
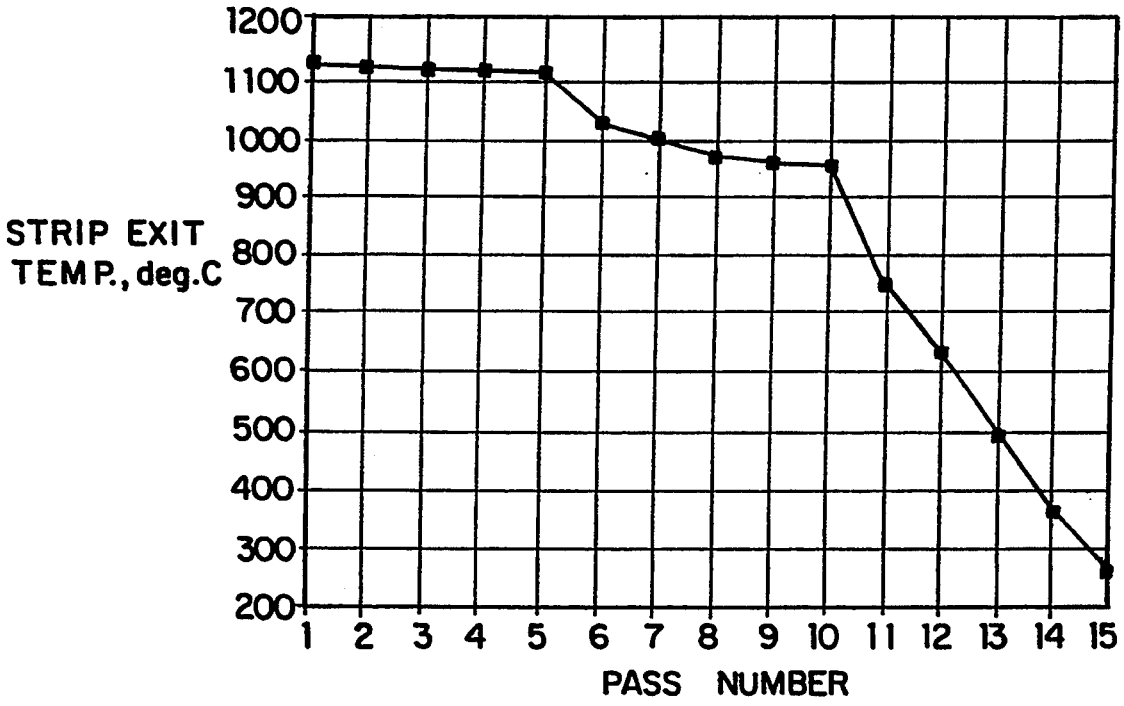
FIG. 7 is a graph showing the temperature of the slab as it passes through each rolling stand in accordance with a second preferred method of operating the first rolling plant.
Figure 8:
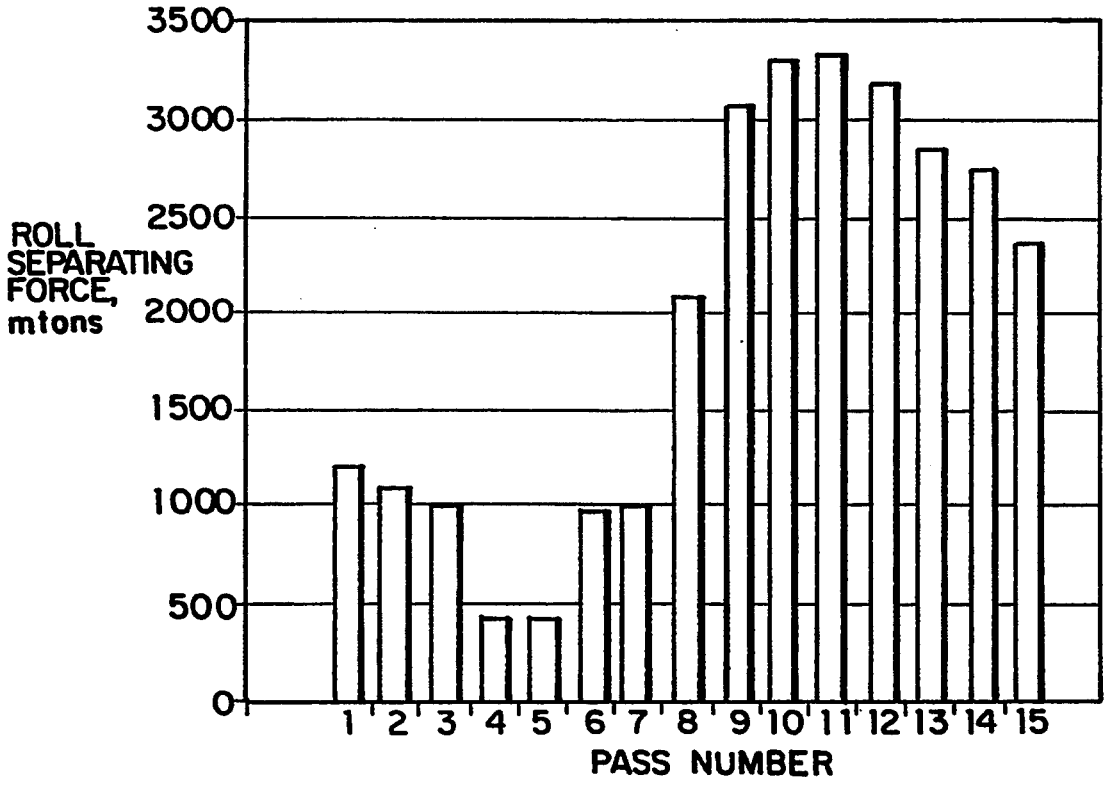
FIG. 8 is a bar graph showing the roll separating force applied to the slab as it passes through each rolling stand in accordance with the second preferred method of operating the first rolling plant.

Referring now to FIGS. 3, 7 and 8, a second preferred method of operating the first rolling plant 10 will be described. In the second preferred method, the first ten passes of the thick workpiece 20, 20' through the series of rolling stands 17 are carried out as described above and as shown in FIG. 3. Depending on the grade of product being produced, the temperature of the workpiece 20, 20' during the first ten passes is preferably at least as high as a first temperature such that the rolling is carried out in the gamma-region, gamma-alpha region or in the upper end of the alpha-gamma region. Preferably, the workpiece 20, 20' with a preferred initial thickness of about 100 mm. to about 160 mm. is rolled through the series of rolling stands 17 with the workpiece 20, 20' at a temperature at least as high as about 900 degrees C. Upon completion of pass number ten through the series of rolling stands 17, the workpiece is in the form of a bar 20' with thickness of about 20 mm. to about 10 mm. or about 8 mm. to about 4 mm., depending upon whether the temperature of the workpiece 20, 20' will be above or below, respectively, the lower cooling transformation temperature during the third pass, and is sufficiently malleable to be coilable in the coiling-unwinding unit 24 in the coiler furnace of the coiling-unwinding station 16.

After the bar 20' completes pass number ten, it is coiled on the coiler drum 24 within the coiler furnace. The heating means 27 associated with the coiler furnace maintains the coiled bar 20' within the coiler furnace at a substantially constant temperature above a critical transformation temperature where the metal in the bar 20' begins to transform from ferrite to pearlite. In the present embodiment, the critical transformation temperature is the lower cooling transformation temperature between the gamma-alpha and the alpha regions. It is preferred that the substantially constant temperature is at a temperature in the range of about 1,000 degrees C. to about 720 degrees C. and, more preferably, between about 1,000 degrees C. to about 800 degrees C. As shown in FIG. 1, the coiler furnace of the coiling-unwinding station 16 is positioned proximate to the first rolling stand 18*a* such that there is not a significant amount of heat loss from the time when the bar 20' exits the coiler furnace and enters the first rolling stand 18*a*.

Next, the bar 20' is uncoiled from the drum 24 at a predetermined rate while the portion of the bar 20' within the coiler furnace is maintained at the substantially constant temperature above the critical transformation temperature such that the bar 20' enters each of the rolling stands 18*a*, 18*b*, 18*c*, 18*d*, 18*e* with a generally constant temperature throughout its length. Preferably, the generally constant temperatures are in the alpha region, in the range of about 720 to about 20 degrees C., and more particularly for some products, the pass through the last rolling stand 18*e* is conducted within the lower temperature range of the alpha region, on the order of about 400 to about 20 degrees C., near room temperature.

The predetermined strip rolling and cooling rates and the substantially constant temperature are selected such that the portion of the bar 20' which is continuously immediately in front of the entrance to each rolling stand is at the generally constant temperature to produce the desired characteristics and proper mechanical deformation in the bar 20' having a finish thickness as thin as 1 mm. As the bar 20' passes through the rolling stands 18*a*, 18*b*, 18*c*, 18*d*, 18*e* it is cooled by using, for example, high-pressure water sprays to lower temperatures in the alpha region. This is shown in FIG. 7, which depicts the temperature of the bar 20' through the last five passes as dropping from about 760 to about 260 degrees C. As shown, rolling in the lower end of the alpha region is accomplished during the last three passes.

Since the coiler furnace 24 maintains the bar 20' within the coiler furnace 24 at a constant temperature, it allows the rolling plant 10 to achieve precise control of the temperature of the bar 20'. This is in contrast, as mentioned above, to the situation in conventional rolling plants, which usually produce substantially thicker gauges at much higher finishing temperature. The data shown in FIGS. 7 and 8 correspond to a slab having a thickness of 120 mm., a width of 950 mm. and an exit thickness of 1.0 mm.

While the foregoing description of the second preferred method applies to the rolling plant 10, it will be understood by those skilled in the art in view of this disclosure that the second method is equally applicable to other reversing rolling plants which include, for example, an exit coiler (not shown) after the fifth rolling stand or a different number of rolling stands, such as two or seven.

Figure 9:
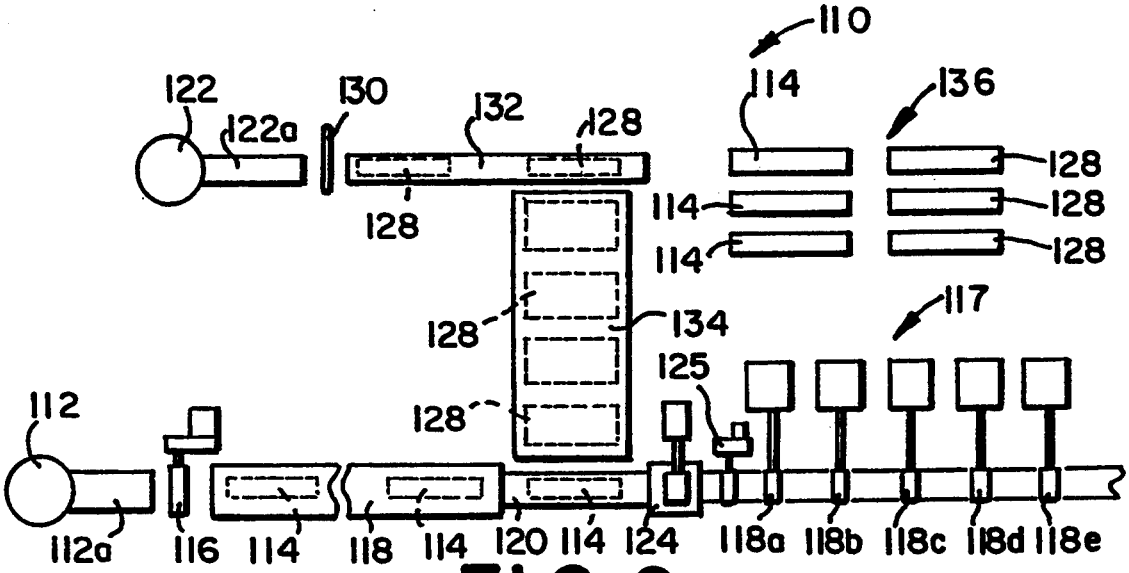
FIG. 9 is a schematic diagram of a second rolling plant in accordance with a second preferred embodiment of the invention.
Figure 10A:
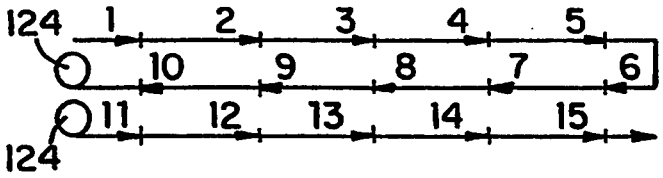
FIGS. 10A–10B are schematic diagrams showing pass roll schedules for the rolling plant shown in FIG. 9.
Figure 10B:
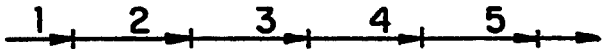

Referring now to FIGS. 9, 10A and 10B, there is shown an apparatus or second rolling plant, generally designated 110, according to the present invention, for the manufacture of hot rolled metal strip. The rolling plant 110 includes a first continuous metal caster 112 for casting a first plurality of castings 114 having a first predetermined thickness. In the present embodiment, the first caster 112 produces a casting a which is generally thin, in the range of about 25 mm. to about 75 mm., but preferably about 50 mm.

Just downstream from the first caster 112 is a first shear 116 for separating the first casting 112*a* into a plurality of first slabs 114*a*. A first furnace 118 is positioned downstream from the shears 116 for receiving the first slabs 114 from the first caster 112. In the present embodiment, it is preferred that the first furnace 118 be a tunnel furnace. However, it is understood by those skilled in the art that other furnaces could be used, such as a stacking furnace, without departing from the spirit and scope of the invention.

A slab discharging table 120 is positioned downstream from the first furnace 119. The slab discharging table 120 receives the first slabs 114 and positions them for entrance into a series of four-high rolling stands 117. In the present embodiment, the series of four-high rolling stands 117 comprises first, second, third, fourth and fifth sequentially positioned four-high rolling stands 118*a*, 118*b*, 118*c*, 118*d* and 118*e*, respectively.

While it is preferred that a series of five four-high rolling stands be used, it is understood by those skilled in the art that any number of rolling stands could be used without departing from the spirit and scope of the invention. For instance, two through seven rolling stands could be used and the particular number of roughing versus finishing stands in each series can also be varied without departing from the spirit and scope of the invention. Moreover, some of the stands could obtain a greater reduction of thickness while other stands could obtain a smaller reduction in thickness, as described above in connection with the embodiment shown in FIG. 1.

Positioned between the series of rolling stands 117 and the slab discharging table 120, is a coiler furnace 124 and a flying shears 125 for removing parts of the leading or trailing ends of the first slabs 114, in a manner well understood by those skilled in the art. The coiling furnace 124, flying shears 125, and series of rolling stands 117 and the remaining portion of the rolling plant 110 downstream from the series of rolling stands 117 are generally identical to the rolling plant 10 described above in connection with FIG. 1. Accordingly, further description thereof is omitted for purposes of convenience only and is not limiting.

As shown in FIG. 9, the rolling plant 110 further includes a second continuous metal caster 122 for producing a casting 122*a* which is separated into a second plurality of slabs 128 having a second predetermined thickness greater than the first predetermined thickness of the first slabs 114. More particularly, the second caster 122 casts a second casting 122*a* having a thickness in the range of about 75 mm. to about 250 mm. Positioned downstream from the second caster 122 is a cutting torch or other suitable device 130 for separating the relatively thick second casting 122*a* of the second caster 122 into the second slabs 128. A second slab discharging table 132 is positioned downstream from the torch 130 for receiving the second slabs 128 after they are separated.

A walking beam reheat furnace 134 is positioned downstream from the second slab discharging table 132 for receiving one or more of the second slabs 128 in a transverse orientation from the second slab discharging table 132. The reheat furnace 134 is positioned between the first and second slab discharging tables 120, 132 and reheats one or more of the second slabs 128 which are then selectively passed to the first slab discharging table 120 for rolling in the series of rolling stands 117.

A slab yard 136 is positioned proximate the second slab discharging table 132 and reheat furnace 134 for holding a plurality of first or second slabs 114, 128 in inventory. Slabs can be inventoried from any source. Thus, the aspect of the present invention illustrated in FIGS. 9, 10A and 10B can be performed even if the plant does not include continuous casters 112 or 122, since the slabs of different thickness can be obtained from vendors. As needed, slabs can be taken from the slab yard 136 and placed within the reheat furnace 134 or tunnel furnace 118 for eventual processing in the series of rolling stands 117, in a manner well understood by those skilled in the art.

In the rolling plant 110, it is preferred that the series of rolling stands 117 be positioned to receive the first and second slabs 114, 128 from the first and second casters 112, 122, such that the rolling plant 110 can roll different grades of strip from each of the first and second slabs 114, 128. More particularly, it is also preferred that the series of rolling stands 117 alternately receive one of the first and second slabs 114, 128 from the first and second casters 112, 122 in a repetitive cycle. The repetitive cycle comprises the series of rolling stands 117 receiving the slabs with a preferred maximum time delay of one minute between the series of rolling stands 117 receiving the alternating first and second slabs 114, 128, as described in more detail hereinafter.

The rolling plant 110 of the present invention is not limited to the use of five rolling stands, a coiling furnace and a flying shears for processing the first and second slabs 114, 128. Any number of other processing equipment can be added to the rolling plant 110 without departing from the spirit and scope of the invention. For instance, a second edger (not shown) could be added after the fifth rolling stand 118*e* or a descale box (not shown) could be added before the coiling furnace 124.

The operation of a rolling plant similar to the rolling plant 110 will now be described with reference to FIGS. 9 and 10A and 10B, except for it has six four-high mill stands. For example, the first caster 112 could cast first casting 112*a* for forming first slabs 114 having a thickness of about 50 mm., and the second caster 122 could cast second castings 122*a* for forming second slabs 128 having a thickness of approximately 250 mm.

The exemplary repetitive cycle begins with the first caster 112 continuously casting the relatively thin casting 112*a* at a casting speed of 5.5 m. per minute. The first shear 116 separates the casting 112*a* from the first caster 112 every 500 seconds to yield the relatively thin first slab 114. This results in a first, exemplary slab 114 having a thickness of about 50 mm., a width of about 1,135 mm. and a weight of about 20.3 tons. The second caster 122 begins casting the relatively thicker second casting 122*a* approximately 205 seconds after the first caster 112 begins casting the first casting 112*a*. The second caster 122 has a casting speed of 1.12 m. per minute. The torch 130 separates the second casting 122*a* from the second caster 122 every 500 seconds to result in a second slab 128 having a thickness of about 250 mm., a width of about 1,112 mm. and a weight of about 20.3 tons. As a result, both the first and second casters 112, 122 have a production rate of approximately 146 tons per hour.

The first slabs 114 exit from the first shear 116 into the first furnace 118 in sequential order. When the head end of one of the first slabs 114 exits the tunnel furnace 118, it takes approximately 29 seconds for it to travel across the first slab discharging table 120 and engage the first rolling stand 118*a* of the series of rolling stands 117. The first slab 114 is then passed through each of the rolling stands within the series of rolling stands 117. The tail end of the first slab 114 exits the last or sixth rolling stand approximately 119 seconds after the head end of the first slab 114 engages the first rolling stand 118*a*. The first slab 114 passes through the series of rolling stands 117 in the manner shown in FIG. 10B (except that six rolling stands are used in this example), to produce a finished strip to the desired gauge, typically greater than about 2.5 mm. thick.

Approximately 57 seconds later, the torch 130 separates a second slab 128 from the second casting 122*a*. The second slabs 128 travel along the second slab discharging table 132 into the reheat furnace 134 in a sequential manner. Thus, the first shear 116 and the torch 130 are actuated every 500 seconds, except that the torch 130 is actuated approximately 205 seconds after the first shear 116 is actuated.

It takes approximately 53 seconds for a second slab 128 to be extracted from the reheat furnace 134 and travel along the first slab discharging table 120 such that the head end of the second slab 128 engages the first rolling stand 118*a* of the series of rolling stands 117. The second slab 128 then passes through the six rolling stands of the series of rolling stands 117, as shown in FIG. 10A (except that FIG. 10A only shows five rolling stands schematically) in a period of approximately 26 seconds. The second slab 128 is then reversed and passed through the series of rolling stands 17 in reverse order in the manner shown in FIG. 10A and then coiled within the coiler furnace 124. This second pass takes approximately 52 seconds. The second slab 128 is then uncoiled from the coiler furnace 124 and passed through the series of rolling stands 117, as shown in FIG. 10A. This pass takes approximately 106 seconds to complete. Thus, from the time a second slab 128 is extracted from the reheat furnace 134 until its tail end leaves the last rolling stand 118e of the series of rolling stands 117 according to the schedule of FIG. 10A, approximately 237 seconds have expired.

Given the foregoing timing, it is apparent that it takes approximately 500 seconds to produce a first slab 114, and 148 seconds to pass a first slab 114 through the series of rolling stands 117. When the torch 130 is operated 205 seconds after the operation of the first shears 116, the head end of one of the second slabs 128 is not extracted from the reheat furnace 134 until 57 seconds (i.e., the gap time) after the tail end of one of the first slabs exits from the series of rolling stands 117. Similarly, the gap time between the exit of the tail end of one of the second slabs 128 from the last rolling stand 118*e* of the series of rolling stands 117, to the exit of the head end of the one of the first slabs 114 from the first furnace 116, is approximately 58 seconds. By continuously repeating this cycle, the gap time alternates between 57 seconds and 58 seconds, depending upon whether a first or second slab 114, 128 was last rolled. The foregoing repetitive cycle results in minimum delays between slabs and a highly productive rolling mill.

It will be understood by those skilled in the art in view of this disclosure that the rolling plant 110 could be operated to achieve other gap times depending upon the size of the casting, type of finished product and number of rolling stands employed without departing from the spirit and scope of the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. In a method for producing thin strip from slabs of a desired length, whereby the slabs are heated, then undergo a reduction of width and are then descaled and rolled in table, upstream a first coiler and downstream a second coiler, the improvement comprising producing the thin strip from both thick and thin slabs comprising the steps of:

(a) first progressively rolling each thick slab in the series of rolling stands pre-set for a first series of thickness reduction for that first rolling;

(b) resetting the roll stands for a second series of thickness reduction;

(c) repassing the first progressively rolled slab through the series of rolling stands in the reverse direction to produce a coilable bar;

(d) coiling and heating the bar within a coiler furnace while maintaining the bar at a substantially constant temperature above a critical transformation temperature at which metal in the bar begins to transform from ferrite to pearlite;

(e) resetting the roll stands again for a third series of thickness reduction;

(f) uncoiling the bar from the coiler; and (g) cooling and simultaneously re-rolling the bar through the series of rolling stands to produce a final strip, whereby the bar is at a temperature below the critical transformation temperature; and (h) progressively rolling each thin slab in the series of the rolling stands pre-set for a single pass thickness reduction by each stand to produce a final strip;

the thickness reduction applied by the stands being greater in a first predetermined number of stands compared to a smaller thickness reduction of a second predetermined number of stands in the series of the rolling stands.

2. A method as recited in claim 1, whereby the series of rolling stands provides for a minimum of three rolling stands and a maximum of seven rolling stands.

3. A method as recited in claim 1, whereby the first predetermined number of rolling stands providing the greater thickness reduction are set for a thickness reduction of between about 24% and about 60%.

4. A method as recited in claim 1, whereby the second predetermined number of rolling stands providing the smaller thickness reduction are set for a thickness reduction of between about 4% and about 15%, during steps (a) and (c).

5. A method as recited in claim 1, whereby the ratio between the thickness of the slab when leaving the series of rolling stands in step (a) and a radiation time for this thickness is greater than about 0.75 mm. per second.

6. A method as recited in claim 1, wherein each thick slab has a thickness of about 75 mm. to about 250 mm.

7. A method as recited in claim 1, wherein the thin slab has a thickness of about 25 mm. to about 75 mm.

8. A method as recited in claim 1, wherein slab after step (c) has a thickness of about 10 mm. to about 20 mm.

9. A method as recited in claim 1, wherein slab after step (c) has a thickness of about 4 mm. to about 8 mm.

10. A method as recited in claim 1, wherein step (g) is conducted at a temperature in the range of about 400 degrees C. to about 20 degrees C. in at least one of the rolling stands in the series of rolling stands.

11. A method as recited in claim 1, wherein the substantially constant temperature of step (d) is at a temperature in the range of about 1,000 degrees C. to about 720 degrees C.

12. A method as recited in claim 1, wherein steps (a) and (c) are conducted at a temperature at least as high as 900 degrees C.

13. A method as recited in claim 1, wherein the critical transformation temperature is in the range of about 720 degrees C. to about 600 degrees C.

14. A method as recited in claim 1 wherein steps (a) through (g) and step (h) are carried out alternatively in a repetitive cycle.

15. A method as recited in claim 14 wherein there is a maximum gap time of about one minute between the completion of step (g) and the commencement of step (h) and the alternate completion of step (h) and the commencement of step (a).

16. In a method for producing thin strip from slabs of a desired length, whereby the slabs are heated, then undergo a reduction of width and are then descaled and rolled in a series of rolling stands having downstream a cooling roller table, upstream a first coiler and downstream a second coiler, the improvement comprising producing the thin strip from both thick and thin slabs comprising the steps of:

(a) first progressively rolling each thick slab in the series of rolling stands pre-set for a first series of thickness reduction for that first rolling;

(b) resetting the roll stands for a second series of thickness reduction;

(c) repassing the first progressively rolled slab through the series of rolling stands in the reverse direction to produce a coilable bar;

(d) coiling and heating the bar within a coiler furnace;

(e) resetting the roll stands again for a third series of thickness reduction;

(f) uncoiling and re-rolling the bar through the series of rolling stands to produce a final strip; and (g) progressively rolling each thin slab in the series of the rolling stands pre-set for a single pass thickness reduction by each stand to produce a final strip;

the thickness reduction applied by the stands being greater in a first predetermined number of stands compared to a smaller thickness reduction of a second predetermined number of stands in the series of the rolling stands whereby in the case of a thick slab having a starting thickness in a range of 100 to 150 mm., a final strip thickness in a range of 1.0 to 1.5 mm. and a final strip with in the range of 1,000 to 1,500 mm., the thickness reductions for a series of five rolling stands consisting of two first stands for producing the greater thickness reduction and three second stands for producing the smaller thickness reduction are about as follows:

for step (a): 26–27%; 25–26%; 10–11%; 10%; 9%;

for step (c): 5–6%; 6%; 8–9%; 49%; 43–44%;

for step (f): 52–53%; 44–45%; 31–32%; 27–28%; 21–22%.

* * * * *